United States Patent [19]

Kawamata

[11] 4,438,721

[45] Mar. 27, 1984

[54] SEALANT APPLYING APPARATUS FOR CAN BODY BLANKS

[75] Inventor: Kiyoshi Kawamata, Ohmiya, Japan

[73] Assignee: Nihon Seikan Kabushiki Kaisha, Japan

[21] Appl. No.: 250,677

[22] Filed: Apr. 3, 1981

Related U.S. Application Data

[62] Division of Ser. No. 35,904, May 3, 1979, abandoned.

[51] Int. Cl.[3] ..... B05C 1/08; B05C 1/16

[52] U.S. Cl. ..... 118/249; 29/121.7; 29/121.8; 101/248; 118/211; 118/221; 118/258; 156/69; 156/578; 427/284; 427/428

[58] Field of Search ..... 101/213, 248; 29/121.6, 29/121.7, 121.8; 118/244, 249, 258, 211, 216, 221; 156/69, 578; 427/284, 438

[56] References Cited

U.S. PATENT DOCUMENTS 4,066,808 1/1978 Carter ..... 118/221 X 4,106,431 8/1978 Howatt ..... 118/262 X

*Primary Examiner*—Robert A. Dawson

*Attorney, Agent, or Firm*—Wenderoth, Lind & Ponack

[57] ABSTRACT

A can manufacturing method comprises applying a water-soluble resin sealing substance to the side and end seam edges of a can body blank and end plates, producing a thin layer of sealing substance on the side and end seam edges under hot drying atmospheres, seaming the side edges of the body blank including the end edges of the end plates to form a complete can, and subjecting the seamed portions to an applied heating to allow the layered sealing substance in the seamed portions to melt and unite the seamed portions. The apparatus permits a sealing substance to be applied on the side edges of a can body blank on the conveying path.

2 Claims, 31 Drawing Figures

SEALANT APPLYING APPARATUS FOR CAN BODY BLANKS

This is a Divisional of Ser. No. 35,904, filed May 3, 1979, now abandoned.

BACKGROUND OF THE INVENTION

1. Field of the Invention

The present invention relates a can manufacturing method and sealant coating apparatus, and more particularly to a method of applying a thin coating of sealing substance to the side seams of a can body blank and the end seams of the end plates, and an apparatus to perform the coating.

2. Description of the Prior Art

The conventional method of manufacturing a can employs a solder of joining the side and end seams of a large-capacity can for the purpose of sealing and reinforcement. For small cans, it uses adhesives or packings in the seams for the same purposes. The use of the solder restricts the type of blank materials than can be used, and requires an additional washing process for soldered cans. When using adhesives or packings, regardless of the cohesive bonds or rubber packings to be used, precautions in handling can components are necessary to avoid direct contact of the adhesives or packings with any part of the manufacturing equipment. Thus, the efficient manufacturing operation is considerably prevented.

OBJECTS OF THE INVENTION

One of the objects of the invention is to eliminate the demerits of the prior art, and provide a can which does not use the solder, cohesive bonds or packings but can be kept tightly sealed.

Another object is to provide a method of manufacturing such a can without any additional washing process and without any manufacturing limitations such as selection of blanks.

A further object is to provide an apparatus for applying a uniform coating of sealing substance on the side and end seam edges of a can body blank.

SUMMARY OF THE INVENTION

In accordance with the present invention, a sealing substance which does not tend to cohere at normal ambient temperatures is used, and a thin coating of sealing substance is applied to a given width of the side and end seam edges of a can body and end plates. A formed can is placed under an applied heating to allow the sealing coating to melt and unite the seams, and can thus be kept airtight without use of the solder, rubber packing or cohesive adhesive. The sealing substance for use with the present invention must have characteristics, such as the capability to form a non-cohesive thin layer at ambient temperature, melting and uniting the seams under an applied heating, having an affinity with can blank materials, having a chemical stability which does not affect the contents of a can, and is harmless. The location and width of of the body blank and end plates on which a thin coating of the sealing substance is to be applied is determined depending upon the form, size and usage of a finished can. A coating should be applied to ensure that some of the applied substance be placed within the bounds of the side and end seam edges along the length thereof. For example, it is preferable that a small width(about 0.5 mm) at the extreme outer edges be left uncoated rather than coating the entire width.

BRIEF DESCRIPTION OF THE ACCOMPANYING DRAWINGS

Other objects and advantages of the present invention will become apparent from the description of the specification which follows with reference to the accompanying drawings, in which:

FIG. 1 is a front view showing a thin coating on the upper face of each of the opposite side edges;

FIG. 2 is a cross sectional view of the embodiment of FIG. 1;

FIG. 3 is a front view showing a thin coating over the width of the left side edge and a thin coating double the width of the right side edge;

FIG. 4 is a cross sectional view of the embodiment of FIG. 3;

FIG. 5 is a front view showing a thin coating over the width of each of both faces of the left and right side edges;

FIG. 6 is a cross sectional view of the embodiment of FIG. 5;

FIG. 7 is a front view showing a thin coating double the width of the upper face of the left side edge and the reverse face of the right side edge, and a thin coating over the width of the reverse face of the left side edge and upper face of the right side edge;

FIG. 8 is cross sectional view of the embodiment of FIG. 7;

FIG. 9 is a cross sectional view showing a thin coating double the width of both faces of each of the left and right side edges;

FIG. 10 is a front view showing a thin coating double the width of the upper face of each of the upper and lower end edges;

FIG. 11 is a cross-sectional view of the embodiment of FIG. 10;

FIG. 12 is a front view showing a thin coating over the width of both faces of each of the upper and lower end edges;

FIG. 13 is a cross sectional view of the embodiment of FIG. 12;

FIG. 14 is a front view showing a thin coating double the width of the upper face of each of the upper and lower end edges;

FIG. 15 is a cross sectional view of the embodiment of FIG. 14;

FIG. 16 is a front view showing a thin coating double the width of the upper face of each of the upper and lower end edges; and a thin coating over the width of each of the reverse faces of the same;

FIG. 17 is a cross sectional view of the embodiment of FIG. 16;

FIG. 18 shows a thin coating double the width of the upper and lower end edges as well as a thin coating over the width of each of the upper and reverse faces of the left side edge and a thin coating double the width of the upper face of the right side edge;

FIG. 19 is a cross sectional view of the embodiment of FIG. 18;

Figure 27:
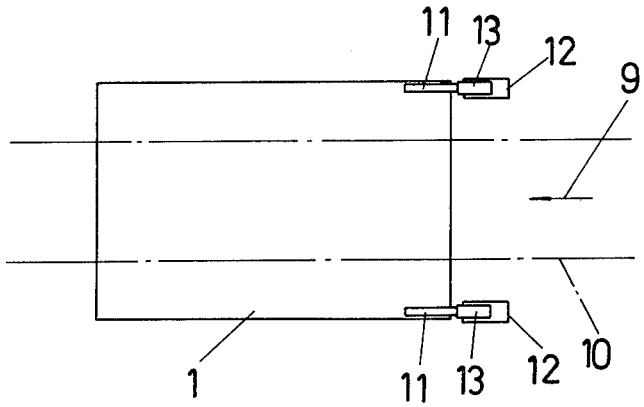
FIG. 27 is a plan view of the sealant coating apparatus according to the present invention.
Figure 28:
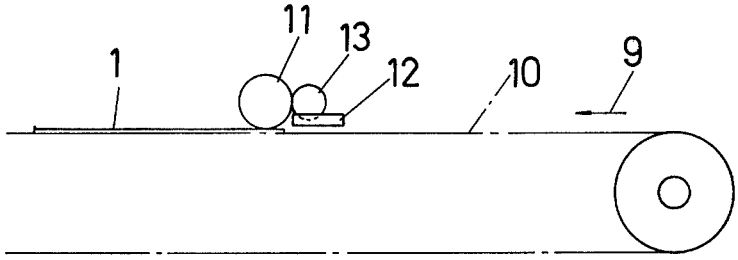
Figure 29:
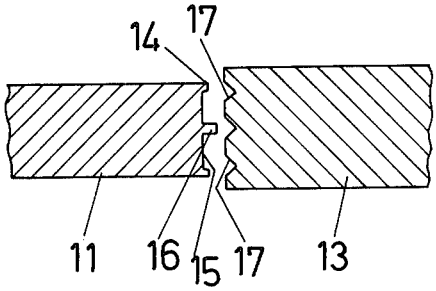
Figure 30:
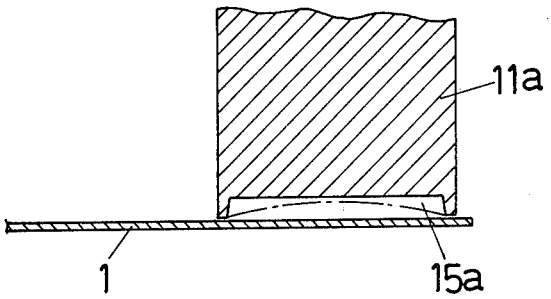
Figure 31:
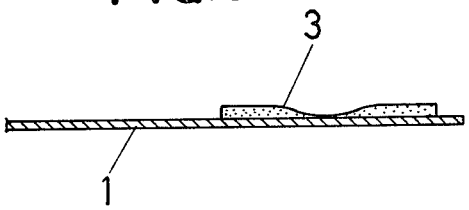

FIG. 28 a front view of the apparatus of FIG. 27;

FIG. 29 is a segmentary enlarged cross-sectional view of the coating roller and the transfer roller;

FIG. 30 is a segmentary enlarged cross-sectional view of the conventional coating roller; and FIG. 31 is an enlarged cross-sectional view of the thin coating obtained according to the coating roller of FIG. 30.

DETAILS OF THE PREFERRED EMBODIMENTS

Figure 1:
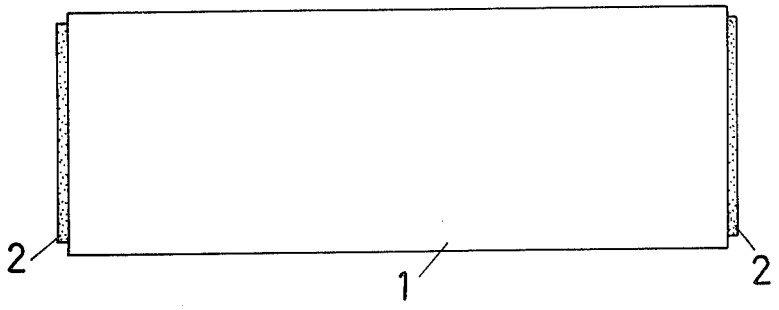
FIGS. 1 through 19 are all embodiments of the present invention having a thin coating of sealing substance on the edges to be seamed of a can body blank.
Figure 2:
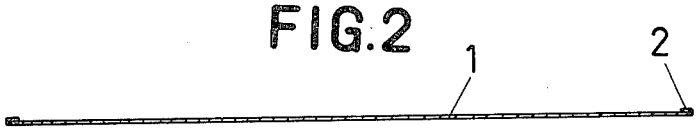
Figure 3:
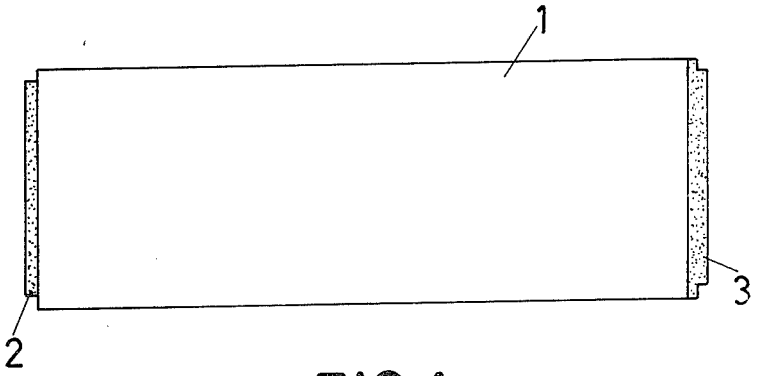
Figure 4:
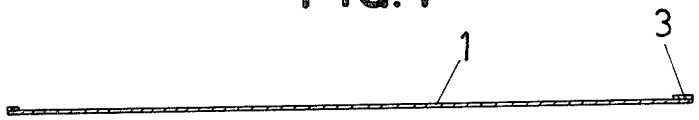
Figure 5:
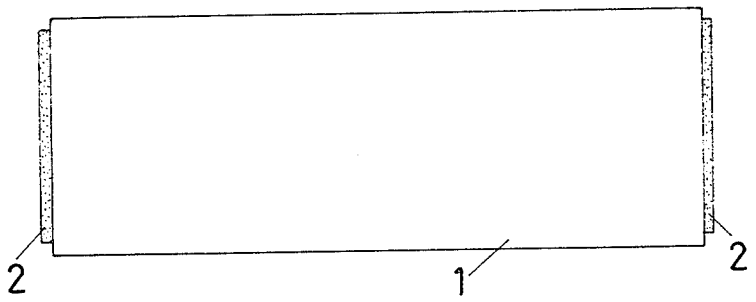
Figure 6:
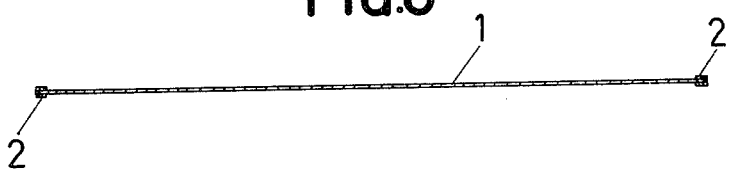
Figure 7:
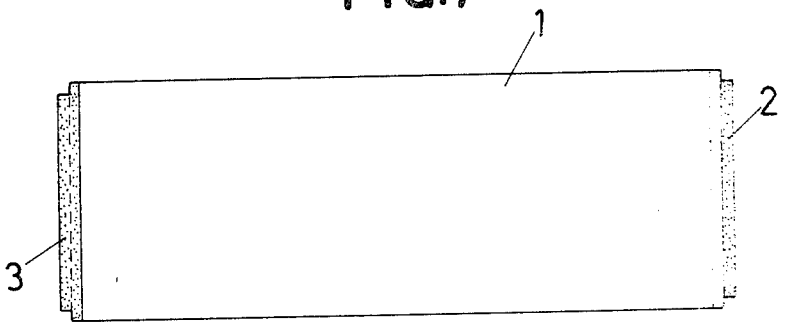
Figure 8:
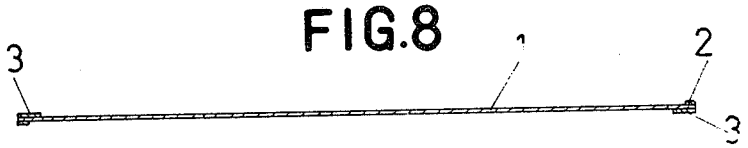
Figure 9:
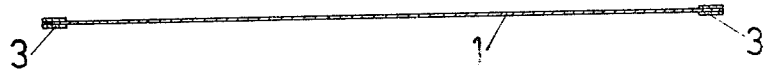
Figure 10:
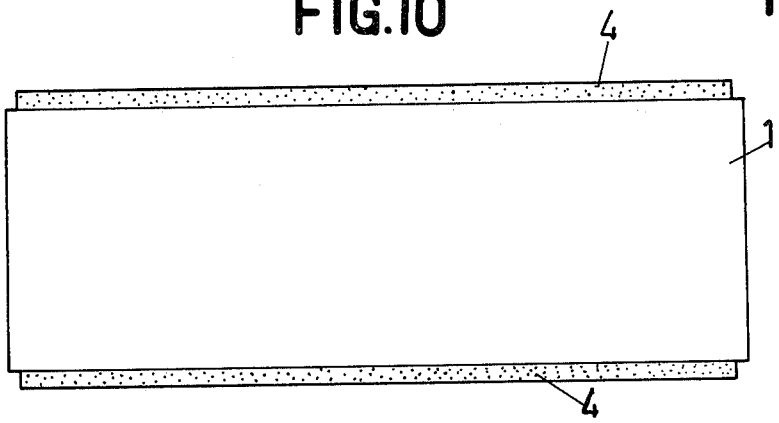
Figure 11:
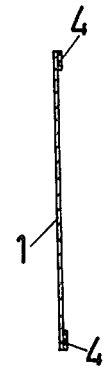
Figure 12:
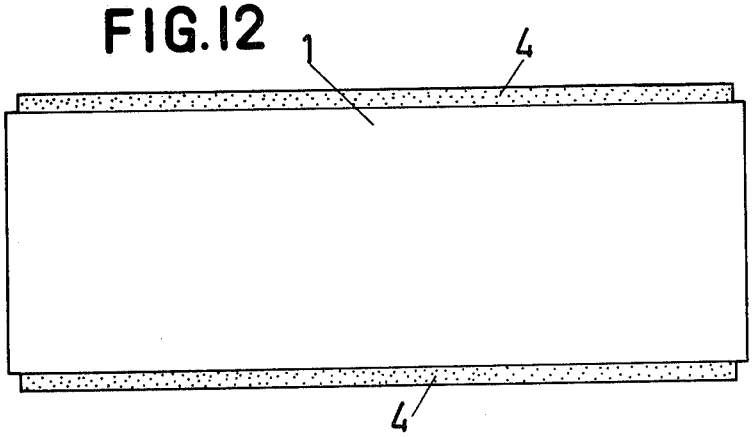
Figure 13:
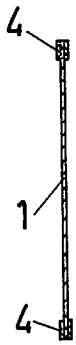
Figure 14:
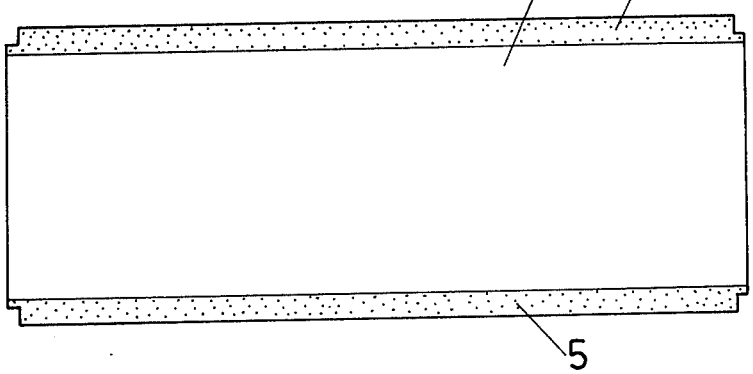
Figure 15:
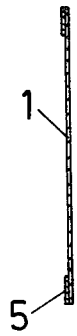
Figure 16:
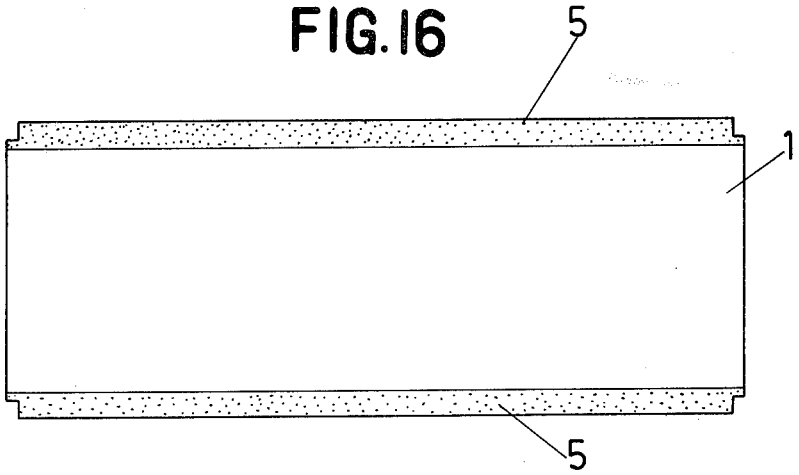
Figure 17:
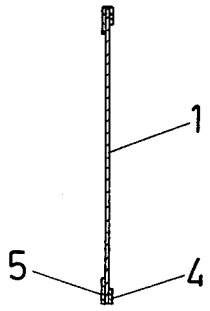
Figure 18:
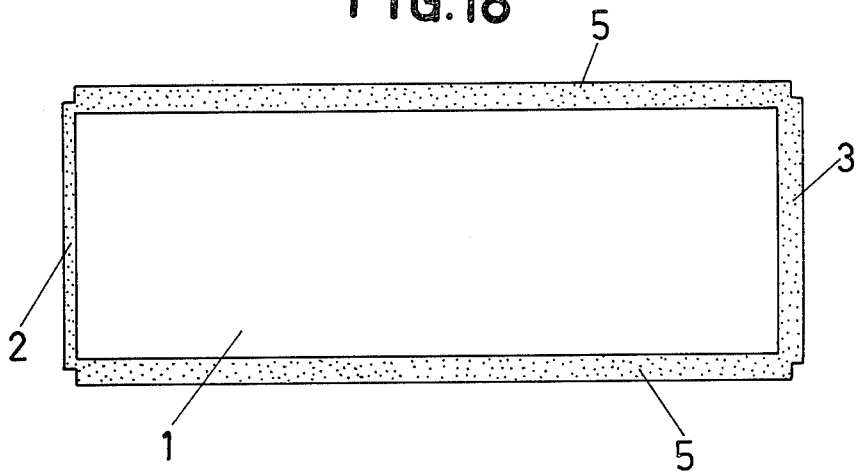
Figure 19:
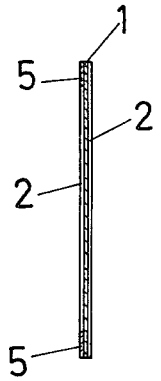

There are provided according to the present invention various embodiments which are now described by referring to the accompanying drawings. In the usual manner, a can of any shape in cross-section consists of two main parts, can body blank and end plates. The can body is originally a blank sheet having opposite side edges to be side-seamed and upper and lower edges to be end-seamed with the end plates. The manner of forming a thin layer of sealing substance on the side and end seam edges is realized in various embodiments according to the present invention. The description is first made with regard to forming a thin layer on the longitudinal side seam edges of a can body blank 1. In FIG. 1, a thin coating 2, 2 of sealing substance is applied only to the upper face of each of the right and left side edges so that the coating can cover the larger part of the width of the edges with some outside part along the length thereof left blank (this manner of coating is hereinafter referred to as "a normal thin coating"). It should be understood that the coating is carried out in all the embodiments to be described below in such a manner that a very small part (about 0.5 mm wide) of the edge located inwards of the outer extremity along the length thereof is left free of the coating for the convenience of handling or treating a can blank. FIG. 2 is a cross section of FIG. 1. In FIG. 3, a normal thin coating 2 is applied to the upper face of the left side seam edge of a body blank 1 and a thin coating 3 is applied to the upper face of the right side seam edge so that the coating can cover double the width of the edge with some outside part along the length thereof left blank (this manner of coating is hereinafter referred to as "a double thin coating "). FIG. 4 is a cross section of FIG. 3. FIG. 5 shows a body blank 1 in which a normal thin coating 2, 2 is applied to the upper and reverse faces of each of the right and left side seam edges. FIG. 6 is a cross section of FIG. 5. In FIG. 7, a normal thin coating 2 is applied to the upper face of the right side seam edge and the reverse face of the left side seam edge, and a double thin coating 3 is applied to the upper face of the left side and the reverse face of the right side. FIG. 8 is a cross section of FIG. 7. FIG. 9 is a cross section showing a double thin coating applied to all the faces of the right and left side seam edges. In an embodiment of FIG. 10, a normal thin coating 4, 4 is applied to the upper face of each of the upper and lower end seam edges of a body blank 1. FIG. 11 is a cross section of FIG. 10. In FIG. 12, a normal thin coating 4, 4 is applied the upper and reverse faces of each of the upper and lower end seam edges. FIG. 13 is a cross section of FIG. 12. FIG. 14 shows another embodiment in which a double thin coating 5, 5 is applied to the upper and reverse faces of each of the upper and lower end seam edges. FIG. 15 is a cross section of FIG. 14. In FIG. 16, a double thin coating 5, 5 is applied to the upper face of each of the upper and lower end seams, and a normal thin coating 4, 4 is applied to the reverse face of each of the upper and lower end seams. FIG. 17 is a cross section FIG. 16. In FIG. 18, a normal thin coating 2, 2 is applied to the upper and reverse faces of the left side seam, a double thin coating 3 is applied to the upper face of the right side seam, and a double thin coating 5, 5 is applied to the upper face of each of the upper and lower end seams. FIG. 19 is a cross section of FIG. 18.

The various embodiments of the present invention shown in FIGS. 1 to 19 and described hereinabove have the two different thin coatings on the side and end seam edges, but in the practical manufacture, the presence or absence of the thin coatings, manner of the coating, and combination of the two different coatings may be of any choice. Any other combinations of the two different thin coatings not described herein are possible.

Figure 20:
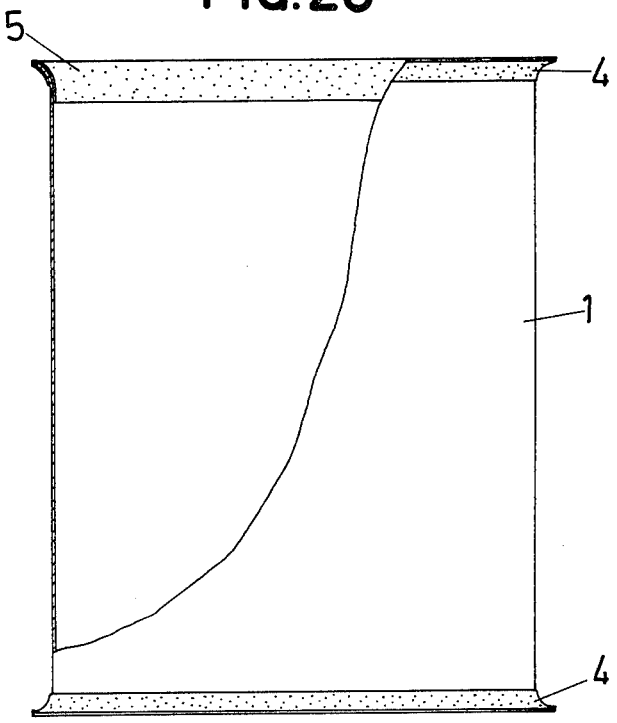
FIG. 20 is a front view of a partly broken-away finished can.
Figure 21:
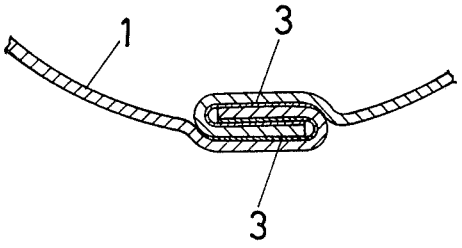
FIG. 21 is an enlarged cross-sectional view of the side seams.
Figure 22:
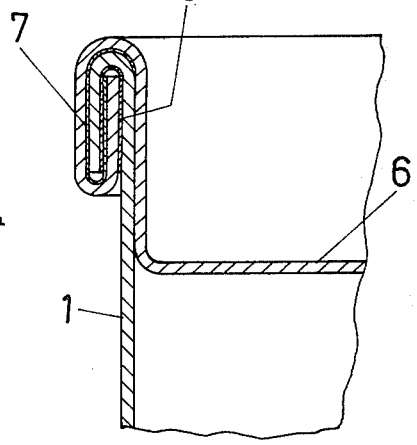
FIG. 22 is an enlarged cross sectional view of the end seams.
Figure 23:
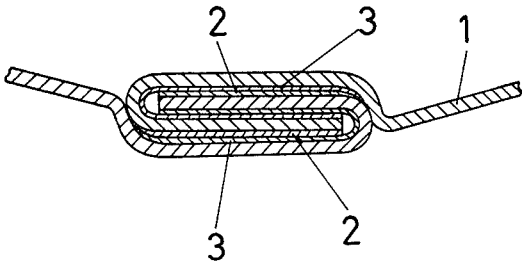
FIG. 23 is an enlarged cross sectional view of the side seams according to the varied embodiment of the invention.
Figure 24:
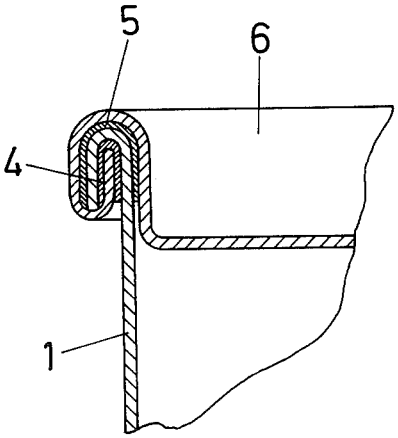
FIG. 24 is an enlarged cross sectional view of the end seams according to the varied embodiment of the invention.
Figure 25:
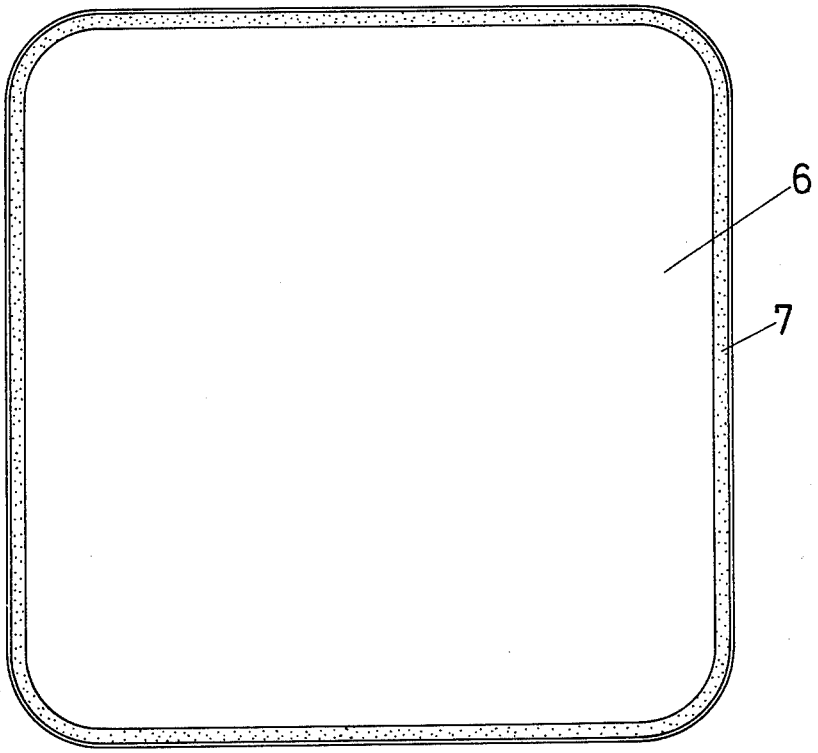
FIG. 25 shows, on an enlarged scale, the reverse side of an end plate for a square-section can.
Figure 26:
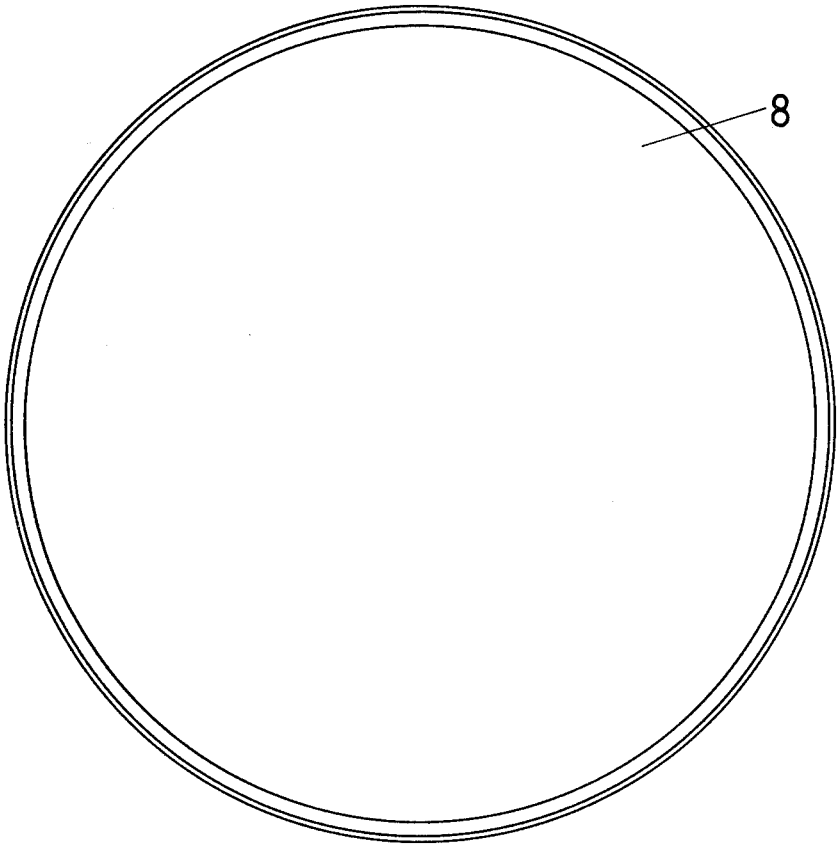
FIG. 26 shows, on an enlarged scale, the reverse side of an end plate for a round-section can.

FIG. 20 is a partly broken-away front view of a finished can according to the invention. FIG. 21 is a cross section, on an enlarged scale, of the side seam of a finished can carrying a double thin coating on the upper face of one side seam and on the reverse face of the other side seam and said side seams being joined in an interlocked hook manner. FIG. 22 is a cross section, on an enlarged scale, of the end seam of a finished can carrying a double thin coating 5 on the upper face of the upper end edge of a body blank 1 and a thin coating 7 on the inside of the peripheral end edge of an end plate 6. FIG. 23 is a cross section, on an enlarged scale, of the side seam of a finished can carrying a double thin coating on the upper face of one side seam edge of a body blank 1, a normal thin coating on the reverse face of the same, a double thin coating on the upper face of the other side seam edge, and a normal thin coating on the reverse face of the same. FIG. 24 is a cross section, on an enlarged scale, of the end seam of a finished can carrying a normal thin coating on the upper face of the upper end edge of a body blank 1 and a double thin coating on the reverse face of the same without any coating on the end seam edge of an end plate 6. FIG. 25 is an enlarged rear view of an end plate 6 of a square cross section carrying a thin coating on the peripheral edge. FIG. 26 is an enlarged rear view of an end plate 6 of round cross section carrying no thin coating on the peripheral edge. In the drawing, reference numeral 7 denotes a thin coating of sealing substance.

The embodiment shown in FIG. 25 has a thin coating on the peripheral edge of the end plate, and the embodiment of FIG. 26 has no such thin coating. If a thin coating is provided on the part of the can body blank, there is no need of the coating on the end plate, this simplifying the manufacturing process. It should be understood, however, that a thin coating can be provided on both elements, i.e., can body blank and end plates.

In the square cross-section cans of the prior art, rubber packing is used in the end plates, but this causes wrinkles or cracks in the area subjected to bending during the curling process. In order to avoid those, therefore, those areas are bent with a somewhat larger curvature. According to the invention, however, the choice of such curvature is at liberty, and any desired curvature will not damage the airtightness. Large-capacity cans usually and absolutely use a solder, but the invention eliminates the use of a solder and yet can keep the finished can airtight.

The process of coating a sealing substance according to the invention is now described. A thin coating of such as Teklon (registered trademark owned by the Nippon Paint Co., Ltd., a water-soluble resin having the viscosity of 200 to 500 CPS at a concentration of 37%) is applied to the upper and reverse faces of the opposite side seam edges of a body blank 1 for a 18-liter can, the width and thickness of the coating corresponding to 3 mm and 70 micron (the thickness at drying time), respectively. The applied coating is subjected to hot drying process to allow itself to adhere to the edges. Then, the opposite sides of the body blank 1 are joined together by side-seaming to constitute a can body, and the seamed sides are finally heated at 180° C. to 200° C. for two minutes to cause the thin coating to melt and unite the seams. End plates 6 having a thin coating on the peripheral edges are joined with the corresponding edges of the can body 1 by curling and end-seaming. The end seams of the formed can is heated at 180° C. to 200° C. for two minutes to cause the end seam coating to melt and unite the end seams. In the above described process, the side seam and end seams are heated separately, but both seams may be heated at the same time.

The coating operation for the various embodiments described hereinabove is performed by the sealant coating apparatus shown in FIGS. 27 to 29, which is now described. The coating apparatus is generally installed above a conveyor 10 on opposite sides thereof, said conveyor 10 moving a can body blank 1 in the direction of an arrow 9. The apparatus has a pair of coating rollers 11 which are rotatably mounted to face the side or end edges of the can body blank 1, and a pair of transfer rollers 13 which are partly immersed in a sealing substance container 12 and whose periphery is spaced from the periphery of the coating roller 11. The coating roller 11 has projections 14, 14 on the opposite sides thereof surrounding the periphery thereof and a central projection 16 surrounding the periphery thereof, the three projections forming a recess 15 therebetween, respectively, and the central projection 16 being slightly longer than the side projection 14, 14. The transfer roller 13 has a plurality of cutouts 17 of V-shaped cross section which surround the periphery of the roller 13, the cutouts 13 facing the corresponding projections on the roller 11. The two rollers 11 and 13 rotate at the same speed, and their peripheral speed coincides with the moving speed of the conveyor 10. In operation, the transfer roller 13 partly immersed in the container 12 supplies its sealing substance to the coating roller 11, which in turn supplies the substance to the edge of the blank 1. The circumferential cutouts 17 on the transfer roller 13 retain the sealing substance therein, and it is therefore possible to transfer an appropriate quantity of sealing substance from the transfer roller 13 to the coating roller 11 even if the blank 1 is carried at higher or highest speed. The recesses 15, 15 between the central projection 16 and the side projections 14, 14 on the coating roller 11 are spaced away from the area to be coated of the blank 1, and it is therefore possible to form a uniform layer of coating over the width and length of the area. The conventional coating roller **11*a* shown in FIG. 30 has a recess 15*a* surrounding the periphery thereof. The use of the roller 11*a* causes an uneven layer of coating 3, thicker layer on both sides and less thick layer or no layer on the center, as shown in FIG. 31. These uneven layers weaken the airtightness of the side and end seams. The coating roller 11** according to the invention eliminates the above deficiency by forming a uniform layer of coating over the width and along the length.

As mentioned earlier, the applied thin coating must be prevented from being adhesive during the can forming operation (otherwise it may easily be damaged or come off by contact with the surrounding machine parts). To this end, it is previously hot dried. There are several methods of final heating. The heating may be localized to the side and/or end seams, or a formed can may be wholly heated through a heating tunnel. The choice of the methods depends upon the reliability of the process, heat economy consideration, the size of the can manufacturing facilities, efficiency and other considerations.

The method and apparatus described according to the present invention present a number of advantages. Namely, a sealing substance applied to the involved parts is previously hot dried, presenting no viscosity at normal temperatures. After forming a can, the sealing coating is finally heated to be allowed to melt and unite the seams airtight. This eliminates the use of solder or packing or adhesive-nature substance, and proteces the coated layer from damages during the can forming process. Non-use of solder eliminates the washing process for a finished can, and allows unlimited use of any kind of materials for cans. The forming process can be carried out at higher rate with the resulting increased productivity. As solder is not used for the purposes of the invention, soldered traces are not produced, thereby making it possible to make the most use of the overall surface of the can for printing thereon, for example. The central projection surrounding the circumference of the coating roller, which is slightly higher than that of the opposite side projections can advantageously cover a relatively great width of the edges to be coated to form a uniform layer of coating. The V-shaped circumferential cutouts on the transfer roller partly immersed in the container can supply a proper amount of sealing substance to the coating roller opposite the transfer roller.

Although the invention has been described by way of the various embodiments thereof, it should be understood that various changes and modifications may be made without departing from the scope and spirit of the invention.

What I claim is:

1. An apparatus for applying a thin coating of sealing substance to the edges to be side-seamed of a can body blank, comprising:

a pair of coating rollers on the opposite sides of the conveying path for carrying a can body blank, each located to face the corresponding longitudinal or lateral side edge of the can body blank for applying a thin coating of sealing substance thereto and each having a central circumferential protrusion, side circumferential protrusions, and circumferential recesses all of which surround the periphery of said coating roller, said central protrusion being slightly higher than said side protrusions; and a pair of transfer rollers each spaced from the corresponding coating roller, each having circumferential V-shaped recesses surrounding the periphery thereof and located opposite the corresponding central and side protrusions of said coating roller, and further having a sealing substance supply container in which said transfer roller is partly immersed.

2. An apparatus as defined in claim 1, wherein the peripheral speed of said coating and transfer rollers coincides with the moving speed of the conveying path.

* * * * *